US006672944B2

(12) United States Patent
Eto et al.

(10) Patent No.: US 6,672,944 B2
(45) Date of Patent: Jan. 6, 2004

(54) INITIAL POSITION SETTING METHOD FOR GRINDING DEVICE

(75) Inventors: Yasuhito Eto, Tokyo (JP); Kenichi Watanabe, Tokyo (JP); Yoshiyuki Hatano, Tokyo (JP)

(73) Assignee: Kabushiki Kaisha Topcon, Tokyo (JP)

( * ) Notice: Subject to any disclaimer, the term of this patent is extended or adjusted under 35 U.S.C. 154(b) by 0 days.

(21) Appl. No.: 10/239,259

(22) PCT Filed: Jan. 22, 2002

(86) PCT No.: PCT/JP02/00433

§ 371 (c)(1),
(2), (4) Date: Sep. 20, 2002

(87) PCT Pub. No.: WO02/057050

PCT Pub. Date: Jul. 25, 2002

(65) Prior Publication Data

US 2003/0077987 A1 Apr. 24, 2003

(30) Foreign Application Priority Data

Jan. 22, 2001 (JP) ..... 2001-13154

(51) Int. Cl.[7] ..... B24B 1/00

(52) U.S. Cl. ..... 451/43; 451/255; 451/256; 451/9; 451/5

(58) Field of Search ..... 451/42, 43, 41, 451/44, 5, 6, 9, 8, 10, 255, 256

(56) References Cited

U.S. PATENT DOCUMENTS

| | | | | | |
|---|---|---|---|---|---|
| 4,286,415 | A | * | 9/1981 | Loreto | 451/43 |
| 5,775,973 | A | * | 7/1998 | Watanabe | 451/5 |
| 6,089,957 | A | * | 7/2000 | Shibata | 451/41 |
| 6,336,057 | B1 | * | 1/2002 | Obayashi | 700/164 |

* cited by examiner

*Primary Examiner*—Joseph J. Hail, III
*Assistant Examiner*—Hadi Shakeri
(74) *Attorney, Agent, or Firm*—Chapman and Cutler LLP

(57) ABSTRACT

An initial position setting method for grinding work apparatus includes: a grind stone 11; a pair of lens rotating shafts 14, 14 which are capable of approaching and drawing apart each other along a normal line of the grind stone 11; a ditch excavation grind stone 23 and chamfering grind stones 24, 25. A measurement standard 70 with a predetermined shape is adapted to be held by the lens rotating shafts 14, 14. The ditch excavation grind stone 23 and the chamfering grind stones 24, 25 are adapted to be moved to the predetermined position. The lens rotating shafts 14, 14 are adapted to be moved in order for the measurement standard 70 to contact with the ditch excavation grind stone 23 or the chamfering grind stones 24, 25 to obtain a moving distance of the lens rotating shafts 14, 14 when the measurement standard 70 is contacted and to carry out an initial setting for moving distance of the ditch excavation grind stone or the chamfering grind stones on a basis of the moving distance of lens rotating shafts 14, 14 and a dimension of the measurement standard.

4 Claims, 15 Drawing Sheets

INITIAL POSITION SETTING METHOD FOR GRINDING DEVICE

TECHNICAL FIELD

The present invention relates to an initial position setting method by which a V shape grind stone, a flat grind stone, a ditch excavation grind stone or a chamfering grind stone is set for an initial position of grinding work to perform a V shape grinding work, a flat grinding work, a ditch excavation grinding work or a chamfering grinding work of an outer periphery of a round edge in an eyeglass lens.

BACKGROUND ART

In a conventional lens grinding work method for an eyeglass lens, a circular reference lens used as a measurement standard is held by a pair of lens rotating shafts. Then a carriage is moved, for example by a manual operation, and the lens rotating shafts are moved downward (moved along X direction) from a predetermined position for the reference lens to be contacted with a grinding surface of a V shape grind stone or a flat grind stone. The moving distance in this case is measured by pulse numbers of a counter, and then a control of moving position of the lens rotating shafts, a setting of an original working position and the like are performed based on the pulse count numbers.

In this way, because the reference lens is manually contacted with a grinding surface of the V shape grind stone or the flat grind stone, the pulse count number of pulse motor which moves the carriage, can not be accurately measured, this makes the moving distance of carriage for every one pulse count incorrect, and the setting of the working original position of the V shape grind stone or the flat grind stone can not be accurately performed.

Furthermore, in the conventional lens grinding work apparatus, the ditch excavation grind stone and the chamfering grind stone are not composed in a structure by which they can be set accurately at the initial position for grinding work, for this reason a ditch excavation work and a chamfering work are performed with a rough estimation by an operator with reference to grinding state. This causes a problem that the ditch excavation work and the chamfering work are not accurately performed.

An object of the present invention is to provide an initial position setting method and a grinding work apparatus by which a V shape grind stone, a flat grind stone, a ditch excavation grind stone or a chamfering grind stone is set as an initial position of the grinding work apparatus.

DISCLOSURE OF INVENTION

To attain the above described object, this invention, according to claim 1, is characterized by an initial position setting method for grinding work apparatus comprising: a grind stone whose contour of cross section is circular; a pair of lens rotating shafts which are provided movably to approach and separate with reference to the grind stone along a normal line of the grind stone, which are rotatable and shiftable along an axial direction, and which hold a lens to be processed; a dedicated ditch excavation and chamfering grind stones which are provided rotatably and capable of moving to a predetermined position within a trace line of the lens rotating shafts; a driving means which makes the lens rotating shafts rotating, approaching and separating and shifting along the axial direction; and a driving and rotating means which makes the dedicated ditch excavation and chamfering grind stones moving to a predetermined position along the trace line and rotating; a measurement standard with a predetermined shape being held by the lens rotating shafts; the dedicating ditch excavation and chamfering grind stones being moved to a predetermined position within the trace line of the lens rotating shafts; the lens rotating shafts being moved along a normal line in order for the measurement standard to contact with a ditch excavation grind stone or a chamfering grind stones of the dedicating ditch excavation and chamfering grind stones; detecting the contact of the measurement standard with the ditch excavation grind stone or the chamfering grind stone by a contact detecting means; obtaining a moving distance of the lens rotating shafts when the contact detecting means detects the contact; and obtaining and setting an initial position of the lens rotating shafts on a basis of the moving distance and a dimension of the measurement standard.

In accordance with claim 2, an initial position setting method for grinding work apparatus is characterized by comprising: grind stones having a V shape grind stone and a flat grind stone whose contours of cross section are circular; lens rotating shafts which are provided movably to approach and separate with reference to the grind stone along a normal line of the grind stone, which are rotatable and shiftable along an axial direction, and which hold a lens to be processed; and a driving means which makes the lens rotating shafts rotating, approaching and separating and shifting along the axial direction; a measurement standard with a predetermined shape being held by the lens rotating shafts; the lens rotating shafts being moved along a normal line in order for the measurement standard to contact with the V shape grind stone or the flat grind stone; detecting the contact of the measurement standard with the V shape grind stone or the flat grind stone by a contact detecting means; obtaining a moving distance of the lens rotating shafts when the contact detecting means detects the contact; and obtaining and setting an initial position of the lens rotating shafts on a basis of the moving distance and a dimension of the measurement standard.

A grinding work apparatus for carrying out a method according to this invention may be characterized by comprising: a grind stone whose contour of cross section is circular; lens rotating shafts which are provided movably to approach and separate with reference to the grind stone along a normal line of the grind stone, which are rotatable and shiftable along an axial direction, and which hold a lens to be processed; ditch excavation and chamfering grind stones which are provided rotatably and are capable of moving to a predetermined position within a trace line of the lens rotating shafts; a driving means which makes the lens rotating shafts rotating, approaching and separating and shifting along the axial direction; and a driving and rotating means which makes the ditch excavation and chamfering grind stones move to a predetermined position along the trace line and rotate; the driving and rotating means moving the ditch excavation and chamfering grind stones to a predetermined position within the trace line of lens rotating shafts; the driving means moving the lens rotating shafts holding a measurement standard which has a predetermined shape along a normal line in order for the measurement standard to contact with a ditch excavation grind stone or a chamfering grind stone of the dedicating ditch excavation and chamfering grind stones after the driving and rotating means is operated; and the grinding work apparatus further including a contact detecting means to detect the contact of the measurement standard with the ditch excavation grind stone or the chamfering grind stone; a measuring means to obtain a moving distance of the lens rotating shafts when the contact detecting means detects the contact; and a setting means to obtain and to set an actual moving distance for one unit of measuring moving distance on a basis of the moving distance and a dimension of the measurement standard. Because a contact of the measurement standard with the ditch excavation grind stone or the chamfering grind stone is detected by the contact detecting means, and the moving distance of the lens rotating shafts is obtained when the contact detecting means detects the contact, the moving distance can be correctly obtained, and thus the initial position for the lens rotating shafts can be accurately set.

A grinding work apparatus for carrying out a method according to this invention may be characterized by including: grind stones having a V shape grind stone and a flat grind stone whose contours of cross section are circular; lens rotating shafts which are provided movably to approach and separate with reference to the grind stone along a normal line of the grind stone, which are rotatable and shiftable along an axial direction, and which hold a lens to be processed; and a driving means which makes the lens rotating shafts rotating, approaching, separating and shifting along the axial direction; the driving means moving the lens rotating shafts holding a measurement standard which has a predetermined shape along a normal line in order for the measurement standard to contact with the V shape grind stone or the flat grind stone; and the grinding work apparatus further including; a contact detecting means to detect the contact of the measurement standard with the V shape grind stone or the flat grind stone; a measuring means to obtain a moving distance of the lens rotating shafts when the contact detecting means detects the contact; and a setting means to obtain and to set an actual moving distance for one unit of measuring moving distance on a basis of the moving distance and a dimension of the measurement standard. Because a contact of the measurement standard with the V shape grind stone or the flat grind stone is detected by the contact detecting means, and the moving distance of the lens rotating shafts is obtained when the contact detecting means detects the contact, the moving distance can be correctly obtained, and thus the initial position for the lens rotating shafts can be accurately set.

Operation

In the present invention, claim 1, by the arrangement described above, because a contact of the measurement standard with the ditch excavation grind stone or the chamfering grind stone is detected by the contact detecting means, and obtaining the moving distance of the pair of lens rotating shafts when the contact detecting means detects the contact, the moving distance can be correctly obtained and thus the initial position for the lens rotating shafts can be accurately set.

In accordance with claim 2, because a contact of the measurement standard with the V shape grind stone or the flat grind stone is detected by the contact detecting means, and obtaining the moving distance of the lens rotating shafts when the contact detecting means detects the contact, the moving distance can be correctly obtained and thus the initial position for the lens rotating shafts can be accurately set.

BRIEF DESCRIPTION OF DRAWINGS

FIG. 5 is a perspective view to show a carriage arm, a carriage base and so on.

BEST MODE FOR CARRYING OUT THE INVENTION

Hereinafter an embodied mode of a lens grinding work apparatus in accordance with the present invention will be described with reference to attached drawings.

Figure 1:
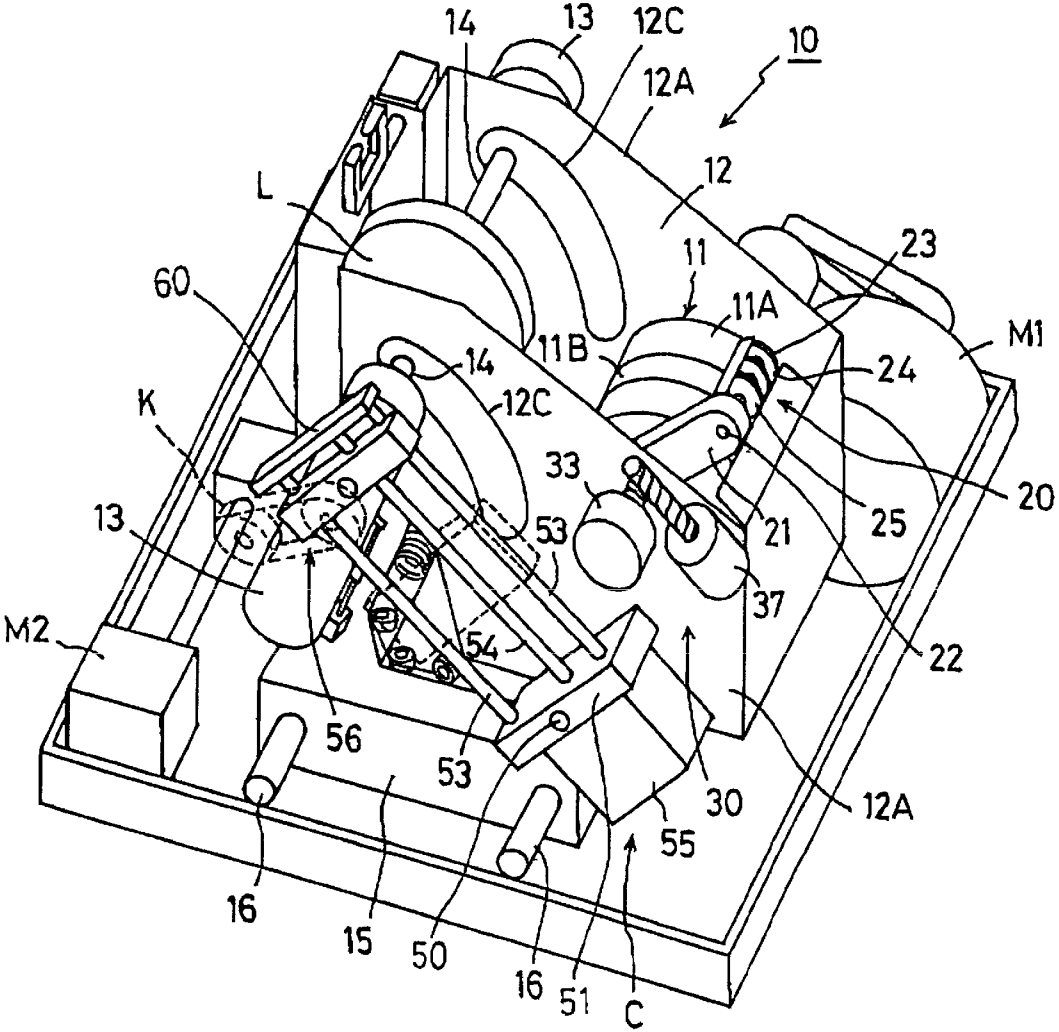
FIG. 1 is a perspective view to show a schematic structure of a lens grinding work apparatus in which an initial position setting method in accordance with the present invention is enforced.
Figure 15B:
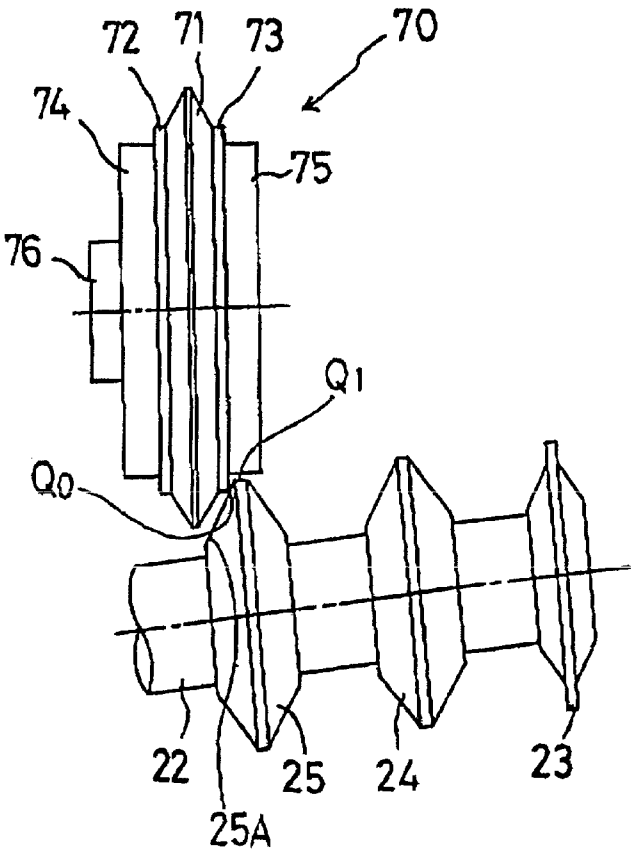
FIG. 15(B) is an explanatory view to show a state in which the chamfering grind stone is contacted with an end portion of the second disk of the measurement standard.

In FIG. 1 a lens processing apparatus (lens grinding work apparatus) 10 includes a working chamber 12 having a grind stone 11 whose contour of cross section is circular, and the grind stone 11 is made rotated at a high speed by a motor M1. The grind stone 11 is composed of a flat grind stone 11A, a V shape grind stone 11B and the like. More specifically, it is composed of a coarse grinding work grind stone for plastic materials, a coarse grinding work grind stone for glass materials, a finishing work grind stone, a V shape work grind stone for V shaped ditch, a mirror finishing work grind stone and a mirror surface V shape work grind stone for V shaped ditch, as shown in FIG. 15.

Figure 5:
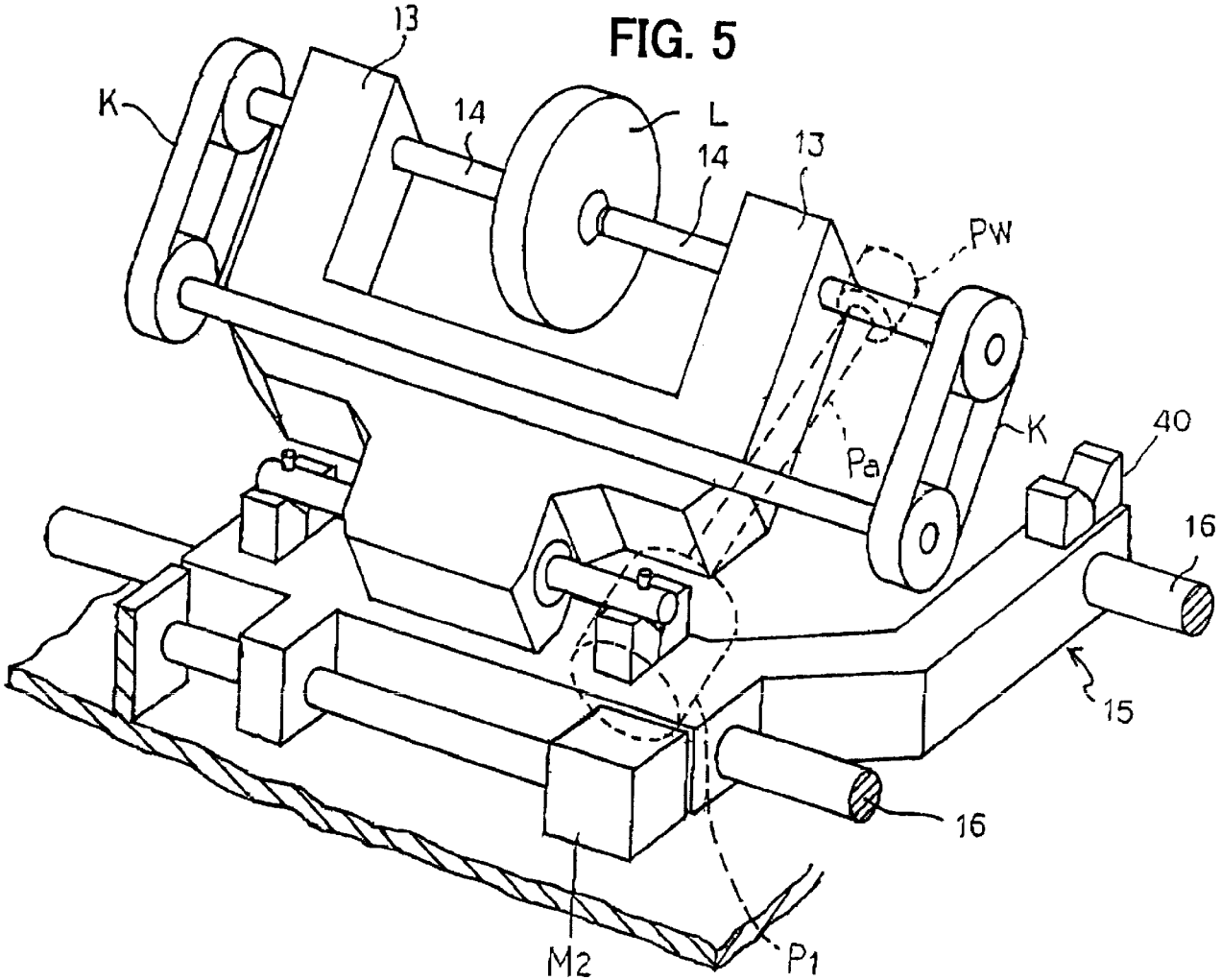

At both outsides of the working chamber 12 there are disposed carriage arms 13, 13, and at a top end portion of the carriage arms 13, 13, there is rotatably provided lens rotating shafts 14, 14, as shown in FIG. 5. The lens rotating shafts 14, 14 are penetrating into an inside of the working chamber 12 through arc-like long holes 12C, 12C which are made at side walls 12A, 12A of the working chamber 12, and the lens rotating shafts 14, 14 are adapted to hold the lens L to be processed between the both end portions thereof. At this point an arc-like plate (not shown) which is made of plastic material to engage with the lens rotating shafts 14, 14, is arranged on the arc-like long hole 12C, and when the carriage arms 13, 13 are turned and moved (moved upward or downward), the lens rotating shafts 14, 14 are also turned and moved (moved upward or downward) and at the same time the arc-like plate made of plastic material (not shown) is adapted to slide and to move in an arc-like motion.

The two lens rotating shafts 14, 14 are adapted to turn through a transmission mechanism K by one pulse motor P1 (see FIG. 5). In other words a worm gear PW is provided at a tip end portion of a driving shaft Pa of the pulse motor P1, and a worm gear (not shown) which is engaged with the worm gear PW is provided on one (right side in FIG. 5) of the lens rotating shafts 14. When the lens rotating shaft 14 of this side is revolved by the pulse motor P1, the other lens rotating shaft 14 is adapted to revolve through the transmission mechanism K.

The lens rotating shafts 14, 14 are, also, capable of approaching for holding the lens to be processed L, and separating for disengaging the lens to be processed L, with respect to each other along the axial direction by a driving mechanism which is not shown in the drawing.

Lower portions of the carriage arms 13, 13 are rotatably held on a carriage base 15, and the carriage arms 13, 13 are swung around the lower portions as a center by a pulse motor 55, because of this swing, the lens rotating shafts 14, 14 are adapted to rise up and go down along the long holes 12C, 12C. When the lens rotating shafts 14, 14 go down, the lens to be processed L which is held between the lens rotating shafts 14, 14 is brought down to a predetermined position to be ground by the grind stone 11.

The carriage base 15 is adapted to be shifted in right and left direction (Y direction) along a guide rail 16 by a pulse motor M2, and by this shift of the carriage base 15 moves in right and left direction, the carriage arms 13, 13 are also moved in right and left direction to make the lens to be processed L moving in right and left direction. Thus a carriage having the lens rotating shafts 14, 14 is composed by the carriage arms 13, 13 and the carriage base 15.

Because of the swing of the carriage arms 13, 13, the lens rotating shafts 14, 14 are adapted to move along a normal line of the grind stone 11 for being capable of approaching and separating.

Figure 4:
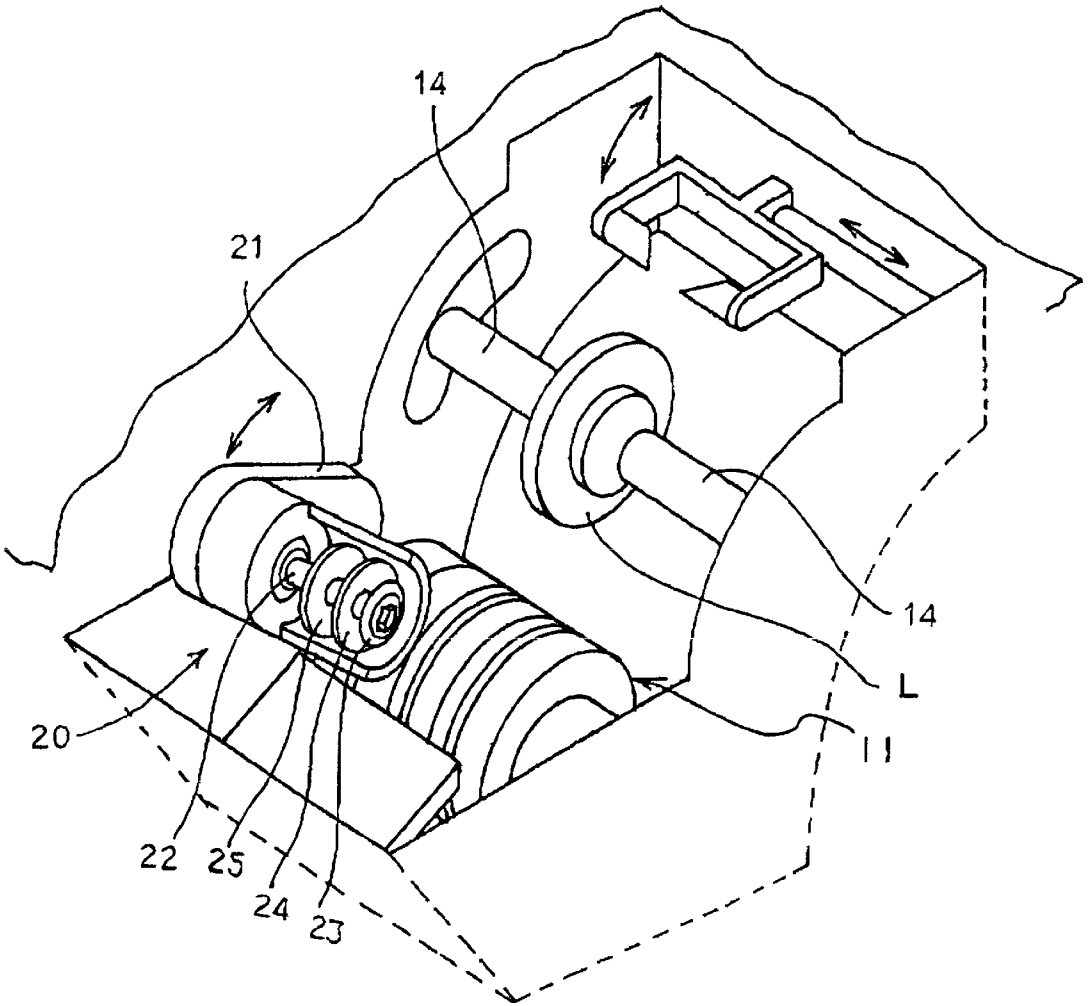
FIG. 4 is an explanatory view to show a chamfering work unit.

Further, a ditch excavation work and chamfering work unit (ditch excavation work and chamfering work means) 20 is provided in the working chamber 12 as shown in FIG. 4. The ditch excavation work and chamfering work unit 20 includes a swing arm 21, a rotating shaft 22 which is rotatable provided at a tip end portion of the swing arm 21, a ditch excavation grind stone 23 and chamfering grind stones 24, 25 which are provided on the rotating shaft 22, and a driving mechanism 30 which is a moving and driving means to swing the swing arm 21 and to drive the rotating shaft 22.

Figure 2:
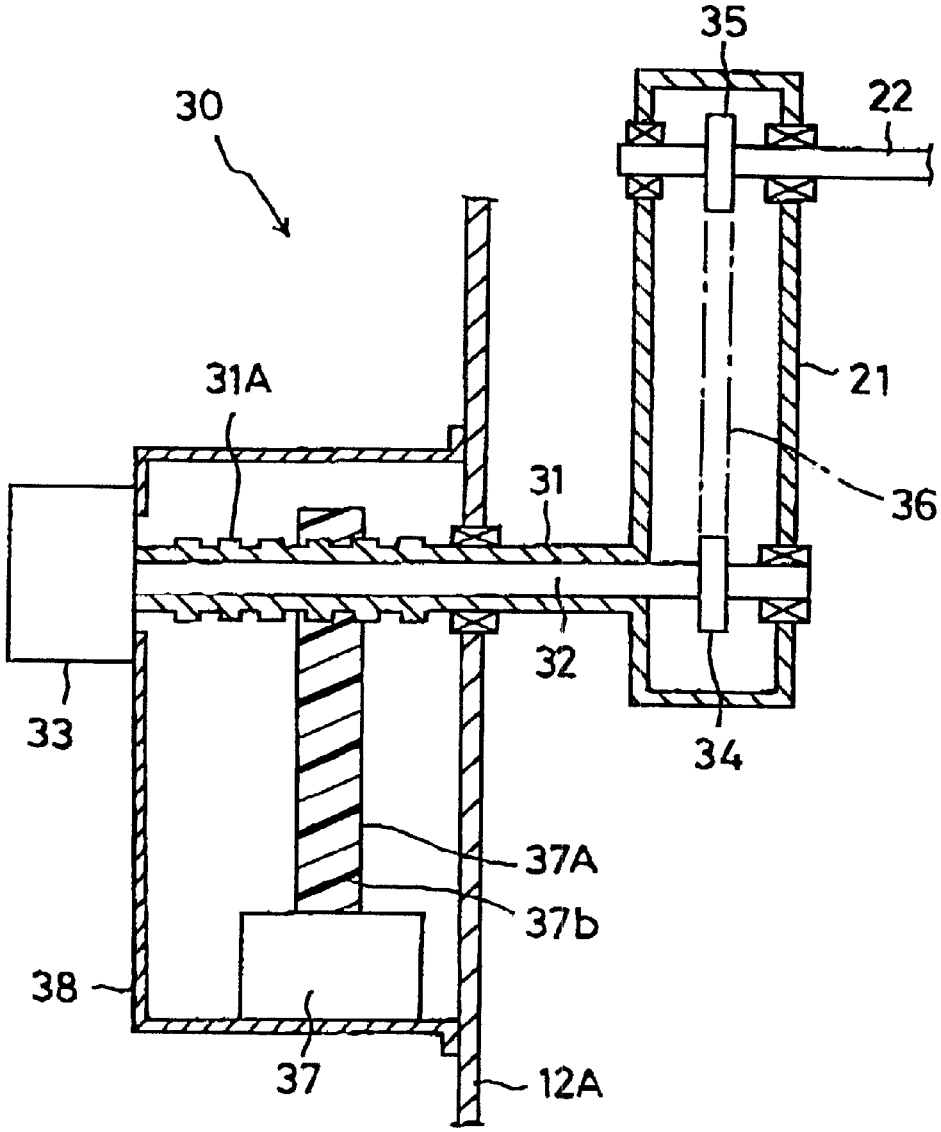
FIG. 2 is an explanatory view to show a structure of driving mechanism of the lens grinding work apparatus shown in FIG. 1.

The driving mechanism 30 includes a cylinder shaft 31 which is provided at a lower portion of the swing arm 21 and which is formed as a hollow pillar, a driving shaft 32 which is rotatably arranged within the cylinder shaft 31, a motor 33 which drives the driving shaft 32, a timing pulley 34 which is provided at a tip end of the driving shaft 82, a timing pulley 35 which is mounted on the rotating shaft 22, a timing belt 36 which is wound between the timing pulleys 34 and 35, a pulse motor 37 which drives the cylinder shaft 31 and so on as shown in FIG. 2.

A worm gear 31A is formed at an outer peripheral portion of the cylinder shaft 31 and the worm gear 31A is engaged with a male screw 37*b* made on a driving shaft 37A which is rotated by the pulse motor 37, when the driving shaft 37A is rotated by the pulse motor 37, the cylinder shaft 31 is made to awing and then the swing arm 21 is also made to swing around the cylinder shaft 31 as a center. On the other hand the rotating shaft 22 is made to be rotated by a rotation of the motor 33 via the driving shaft 32, the timing pulley 34, the timing belt 36 and the timing pulley 35.

The ditch excavation grind stone 23 and the chamfering grind stones 24, 25 are made possible to move to a predetermined position within a trace line of the lens rotating shafts 14, 14 along the normal line by the pulse motor 37.

The motor 33 and the pulse motor 37 are attached onto a bracket 38 which is provided on the side wall 12A of working chamber 12.

Figure 3:
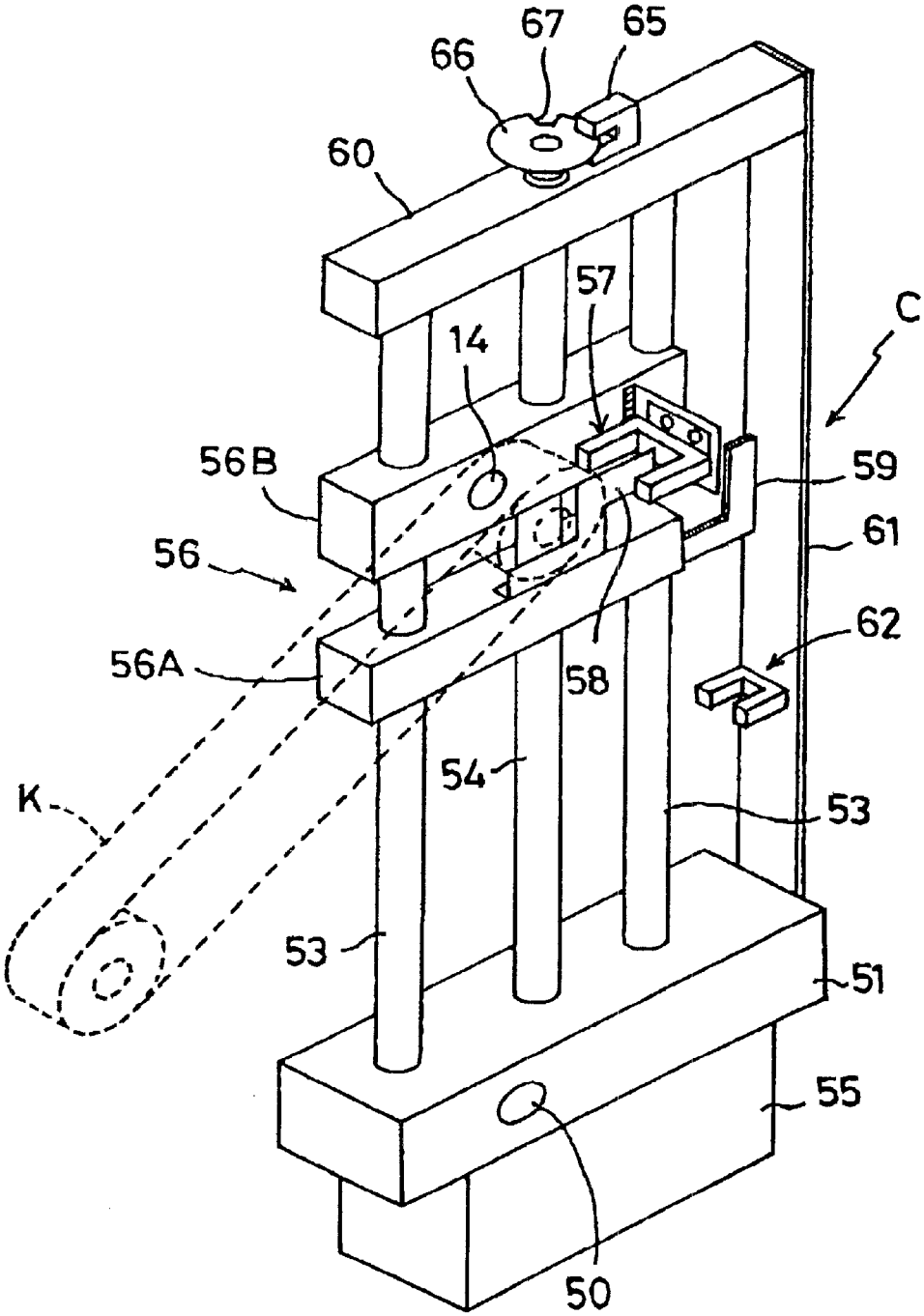
FIG. 3 is an explanatory view to show a structure of adjusting means for distance between the shafts.
Figure 6A:
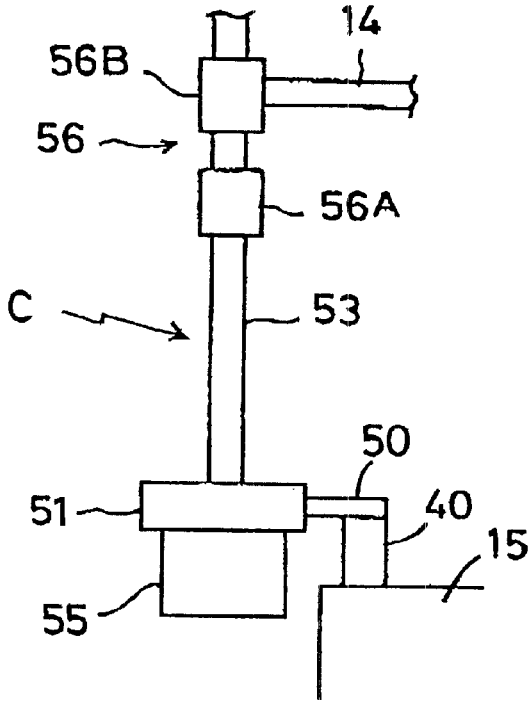
FIG. 6(A) is an explanatory view to show schematically structure by which the adjusting means for distance between the shafts is supported.
Figure 6B:
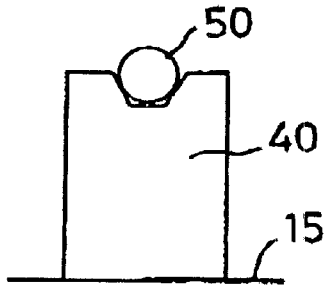
FIG. 6(B) is an explanatory view to show a shaft of the adjusting means for distance between the shafts which is supported by a shaft bearing.

An adjusting means (reciprocating means) C for distance between shafts, is provided at a side portion of the working chamber 12. The adjusting means C for distance between shafts is composed by, as shown in FIG. 1, FIG. 3 and FIG. 6, a base plate 51 swingably attached on a shaft 50 which is disposed coaxially on the same axis of the rotating shaft (not shown) of the grind stone 11, a pair of guide rails 53 which are provided on the base plate 51 and vertically extend upward from a top surface of the base plate 51, a screw shaft 54 which is rotatably provided on the base plate 51 and parallely extends with the guide rails 53, a pulse motor (driving motor) 55 which is provided on an under surface of the base plate 51 to rotate the screw shaft 54 and a supporting table 56 which is made to go upward and downward along the guide rails 53. And at the same time the adjusting means C for distance between shafts is held swingably by a shaft bearing 40 which is provided on the base 15. Also a reinforcing member 60 is fixed on a top end portion of the guide rails 53, the reinforcing member 60 rotatably supports a top end portion of the screw shaft 54.

The supporting table 56 is composed of a first supporting table 56A which is made to go upward and downward along the guide rails 53 by a rotation of the screw shaft 54, and a second supporting table 56B which is put on the first supporting table 56A via a spacer not shown in the drawings. The second supporting table 56B is made to go upward and downward in a coupled movement with that of the first supporting table 56A, and at the same time the second supporting table 56B rotatably supports the lens rotating shaft 14. An optical sensor (finishing sensor, contact detecting means) 57 is provided on the second supporting table 56B, and screening plates 58, 59 are arranged on the first supporting table 56A. The screening plate 58 is adapted always to block light from an emitting portion (not shown) of the optical sensor 57 for shielding. At this point, a straight line connecting between the lens rotating shaft 14 and the shaft 50 is adapted parallel to the guide rails 53.

On the other hand, when the second supporting table 56B is stopped going downward and the first supporting table 56A is further continued to slightly move downward in relation to the second supporting table 56B, the shielding of light by the screening plate 58 is released and a light receiving portion (not shown) of the optical sensor 57 is adapted to begin receiving the light from the emitting portion. By this shielding of light an operation of finishing work for the lens to be processed L is detected.

A supporting plate 61 is also attached between the base plate 51 and the reinforcing member 60, and an origin sensor 62 which is made of an optical sensor to detect an origin for X direction is disposed onto the supporting plate 61. When the lens to be processed L is put down at a predetermined position (a position as the origin in the X direction), the screening plate 59 is made to block light from an emitting portion of the origin sensor 62, and by this shielding of light the origin for the carriage arm 13, 13 is detected.

Another origin sensor (optical sensor) 65 for the pulse motor 55 is provided on the reinforcing plate 60, this origin sensor 65 is arranged to detect a cut portion 67 of circular disk 66 which is provided at a top end portion of the screw shaft 54, and on a basis of detection of the cut portion 67 a pulse number of the pulse motor 55 is counted. When the circular disk 66 is begun to rotate by the pulse motor 55, and then the cut portion 67 is firstly made releasing the shielding of light of the origin sensor 65 (when the origin sensor 65 detects light from the emitting portion (not shown)), that time point is defined as the origin of pulse for the pulse motor 55 and the pulse number is begun to count.

On the other hand the supporting table 56 is arranged to go upward and downward along a straight line connecting between a center of the shaft 50 (a rotation center of the grind stone 11) and a center of the lens rotating shaft 14. The supporting table 56 is engaged rotatably with one end of the lens rotating shaft 14, and by a movement of the supporting table 56 going upward and downward (reciprocating upward and downward) along the guide rails 53, the carriage arm 13, 13 is adapted to swing around the lower portion as a center.

Figure 7:
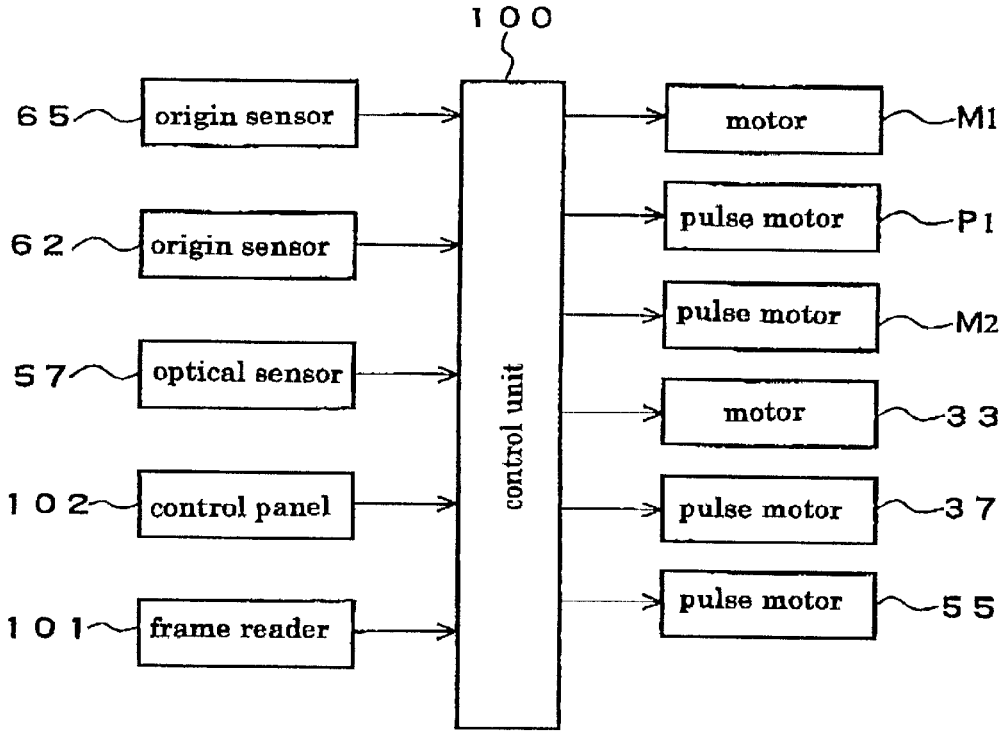
FIG. 7 is a block diagram to show a structure of principal part of a controlling system for the lens grinding work apparatus.

The motors M1 and 33 and the pulse motors 37, 55, M2 and P1 are controlled by a control unit 100 which is shown in FIG. 7. The control unit 100 is arranged to control the motors M1 and 33 and the pulse motors 37, 55, M2 and P1 on a basis of the frame shape data which are output from a frame reader (lens frame-shape measuring apparatus) 101, a key operation of respective key switches (not shown) in a control panel 102, and the like.

Figure 8:
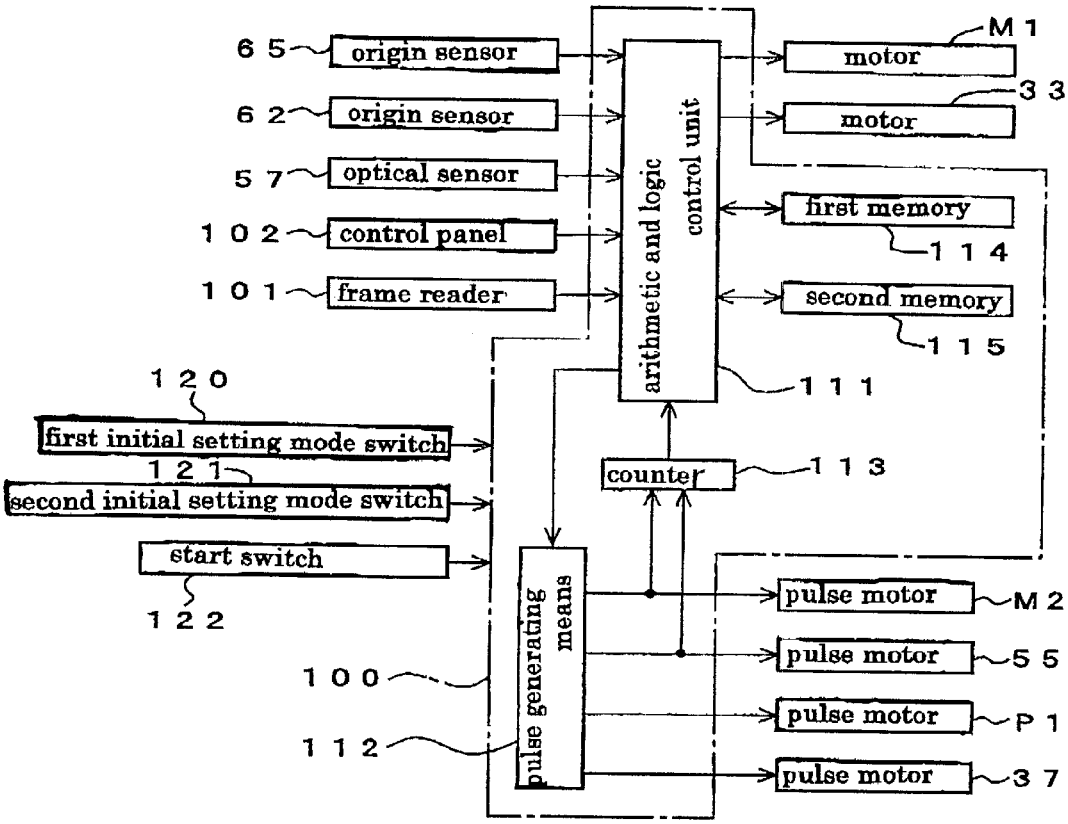
FIG. 8 is a block diagram to show a structure of principal part of a controlling unit.

The control unit 100 is composed of an arithmetic and logic control means (setting means) 111 constituted by CPU and so on, a pulse generating means 112 by which the pulse to control the pulse motors M2, 55, P1 and 37, a counter (measuring means) 113 to count the pulse numbers of pulse motors M2 and 55, a first memory 114 in which the pulse number counted by the counter 113 is stored, a second memory 115 in which an actual moving distance for every one pulse that is obtained by the arithmetic and logic control means 111, and the like, as shown in FIG. 8.

The control panel 102 is provided on a main body case (not shown) of the lens grinding work apparatus 10, and on the control panel 102 a first initial setting mode switch 120 to set an initial setting mode of the ditch excavation grind stone and the chamfering grind stone, a second initial setting mode switch 121 to set an initial setting mode of an ordinary grind stone, a start switch 122, respective key switches (not shown) to start respective operations and so on are provided.

Further the pulse motors M2, 55 and P1 consist of a driving means to move the lens rotating shafts 14, 14 along the normal line of grind stone 11, to rotate the lens rotating shafts 14, 14 and to shift the lens rotating shafts 14, 14 along the axial direction (Y direction).

At this point, because the base plate 51 swings around the shaft 50 as a center which is provided on the same straight line with the rotating shaft of the grind stone 11, the supporting table 56 is made to go upward and downward along a straight line connecting between a center of the shaft 50 and a rotating center of the lens rotating shaft 14 regardless of a size of the lens to be processed L. By this reason a contacting point of the lens to be processed L and the grind stone 11 is arranged to be located on the straight line with regardless to the size of lens to be processed L. By this arrangement a grinding work can be realized without any calibration caused by displacement of the contacting point from the straight line in compliance with a size of the lens to be processed L.

Figure 9C:
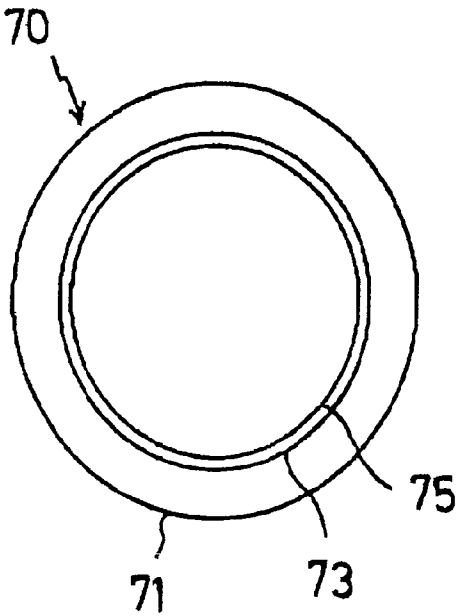
FIG. 9(C) is a right side view to show the measurement standard.
Figure 9B:
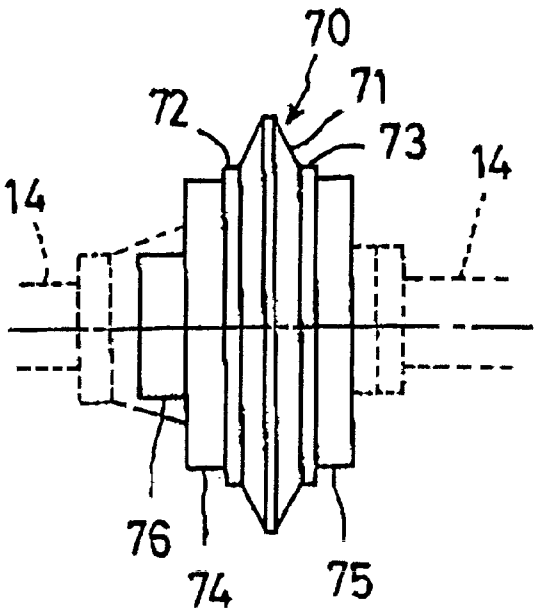
FIG. 9(B) is a front view to show the measurement standard.
Figure 9A:
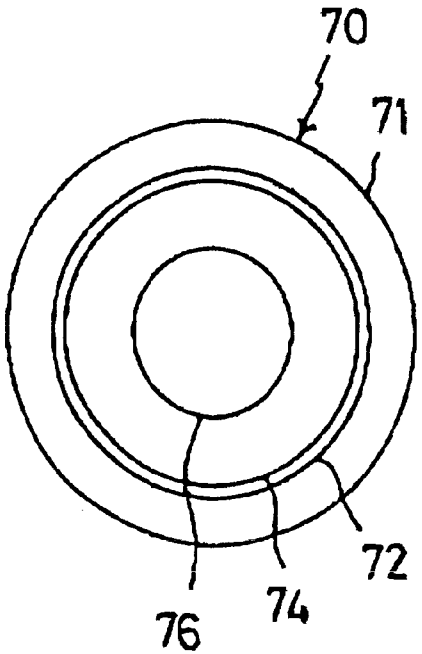
FIG. 9(A) is a left side view to show a measurement standard.

FIG. 9 shows a measurement standard 70 whose size of diameter and thickness are made correctly as an actual value of standard.

The measurement standard 70 is composed with a first disk 71 whose cross section is made in a chevron shape and disposed at a center portion, second disks 72, 73 which are disposed at both sides of the first disk 71 and whose diameter is smaller than that of the first disk 71, third disks 74, 75 which are disposed at both outside of the second disk 72, 73 and whose diameter is smaller than that of the second disks 72, 73, and a fixing disk 76 which is disposed at outside of the third disk 74 and whose diameter is smaller than that of the third disk 74.

These first disk 71, second disks 72, 73, third disks 74, 75 and the fixing disk 76 are coaxially disposed as concentric circles, and for example, a diameter of the first disk 71 is set in 40 mm, a diameter of the second disks 72, 73 are set in 36.2 mm, a diameter of the third disk 74 is set in 35.2 mm, a diameter of the third disk 75 is set in 34.8 mm, thickness of the respective first to third disks are set in respective predetermined values and a material of the measurement standard 70 is selected in order for the sizes of diameter and thickness of the respective disks not to be influenced by variation in temperature. The dimension of first disk to third disk of the measurement standard are not limited to the above described values, however, they must be the same as the values stored in the control unit 100 as the predetermined well known values, or they must be the values which are made to be related to the stored values.

Hereinafter a method will be explained to obtain actual moving distance of the lens rotating shafts 14, 14 utilizing the ditch excavation grind stone 23 and the chamfering grind stones 24, 25 of the lens grinding work apparatus 10 which are configured as described above (1) Ditch Excavation Grind Stone 23

At first the measurement standard 70 is held between the lens rotating shafts 14 and 14. And the first initial setting mode switch 120 is pushed on. When the start switch 122 is pushed on, a pulse is generated in the pulse generating means 112, then the pulse motor 55 is driven, and the supporting table 56 is once raised up in a predetermined constant height. This causes the supporting table 56 goes upward for a predetermined height with amount for pulse number of N0 from a position of the origin sensor 62 where the screening plate 59 shields light from the emitting portion of origin sensor 62, and at the same time from a position of the supporting table 56 where the origin sensor 65 detects the cut portion 67 of circular disk 66.

Next the pulse motor 37 is driven to swing the swing arm 21, and the ditch excavation grind stone 23 is set in a predetermined position between the grind stone 11 and the lens rotating shaft 14. This performed by, for example, that a predetermined number of pulse is input to the pulse motor 37 and the pulse motor 37 is driven to swing the swing arm 21 from an initial position as a evacuating position by a rotation of the pulse motor 37.

Figure 10:
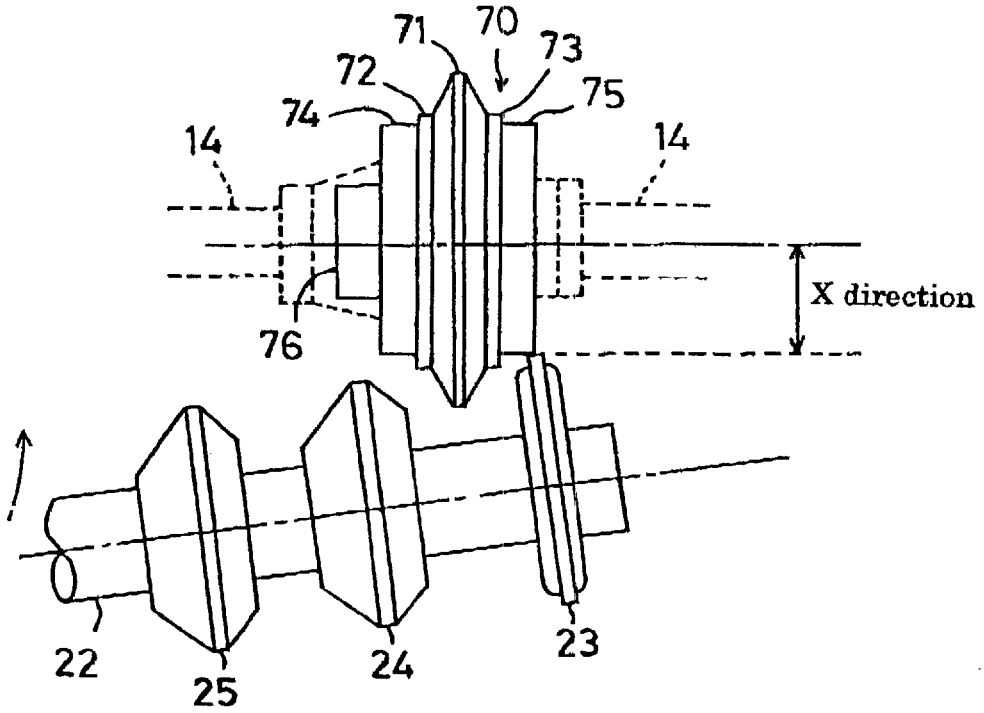
FIG. 10 is an explanatory view to show a state in which the ditch excavation grind stone is contacted with an end portion of a third disk of the measurement standard.

And a pulse is generated in the pulse generating means 112, and the pulse motor 55 is driven then the supporting table 56A is moved downward. By this downward movement of the supporting table 56A, the measurement standard 70 is also moved downward with the lens rotating shafts 14, 14, then the ditch excavation grind stone 23 is made contact with a peripheral surface of the third disk 75 of measurement standard 70 as shown in FIG. 10. By this contact the second supporting table 56B is made apart from the first supporting table 56A and this departure of the second supporting table 56B is detected by the sensor 57. The moving distance till the detection is counted as a pulse number of the pulse motor 55 by the counter 113 and a value N1 of the counted pulse number is stored in the first memory 114.

At the same time by the detection through the sensor 57 the arithmetic and logic control means 111 makes the pulse generating means 112 stopping pulse generation to stop the driving of pulse motor 55.

And when the carriage base 15 is shifted along Y direction by the pulse motor M2, the moving distance along the Y direction is also obtained in the same manner as described above. In other words, pulse number of the pulse motor M2 is counted by the counter 113, and a counted value of the counter 113 is stored in the first memory 114 as the moving distance in correlation with the counted value along the X direction.

Next the pulse motor 55 is driven and controlled for the measurement standard 70 to go upward in a predetermined height. After this the pulse motor M2 is driven and controlled for the measurement standard 70 which is held by the lens rotating shafts 14, 14 to be slightly shifted along Y direction. To be more precise it is shifted in a direction for the ditch excavation grind stone 23 to be contacted with a peripheral surface of the second disk 73 of measurement standard 70 (it moves in the direction shown in FIG. 11). Then the pulse motor 55 is driven and controlled again for the measurement standard 70 to go downward and a pulse count value of the pulse motor 55 and a pulse count value of the pulse motor M2 until the sensor 57 detects a contact, are stored in the first memory 114.

The counted value of pulse motor 55 in the first memory 114 is compared with the counted value which was stored in the previous operation, when the counted values is equal to the previous counted value of pulse, this operation is repeated until the counted value of pulse becomes different from the counted value of the previous operation.

Figure 12:
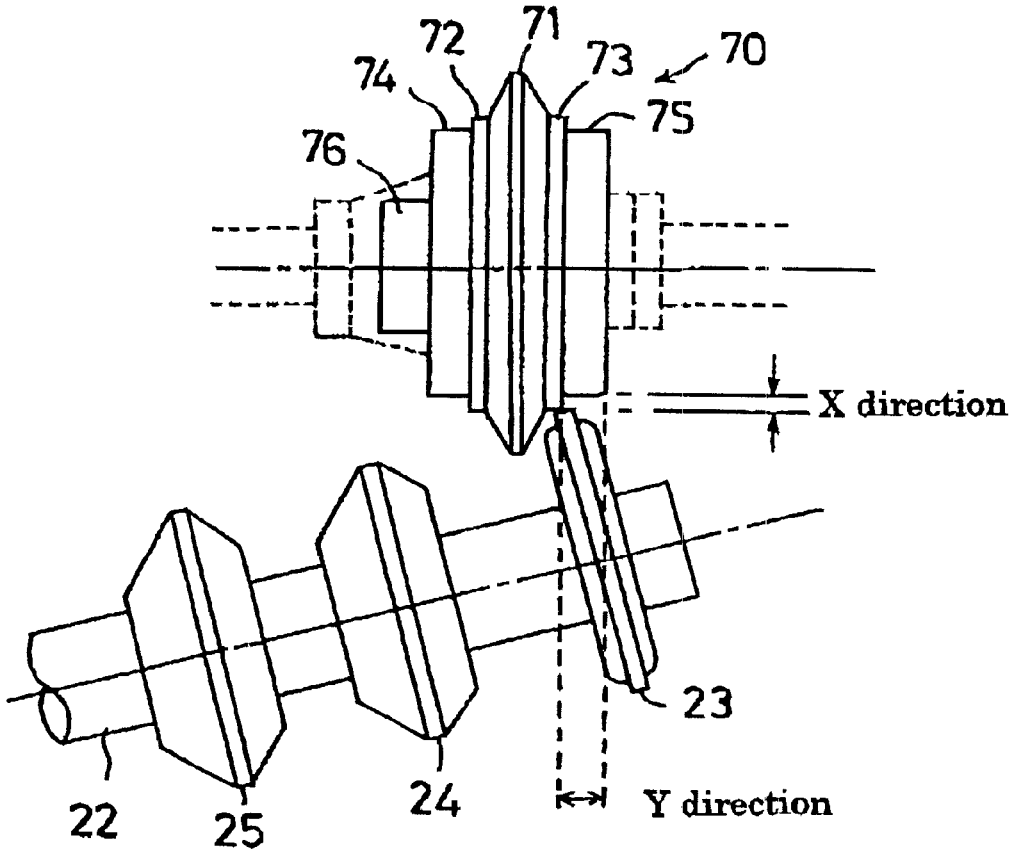
FIG. 12 is an explanatory view to show a state in which the ditch excavation grind stone is contacted with an end portion of a second disk of the measurement standard.

A state where the counted values of pulse are different is realized in a state where the second disk 73 of measurement standard 70 is contacted with a peripheral surface of the ditch excavation grind stone 23 as shown in FIG. 12, then the counted value (second counted value) of pulse motor M2 in the previous state of one cycle before the contact, is stored in the first memory 114 as the moving distance of measurement standard 70 along Y direction.

In the same manner as described above, another contact of the ditch excavation grind stone 23 with peripheral surface of the second disk 73 of measurement standard 70 is detected as shown in FIG. 10, the counted value (first counted value) of pulse motor M2 in the previous state of one cycle before the contact, is stored in the first memory 114 as the moving distance of measurement standard 70 along Y direction.

Because a length of cylinder portion of the third disk 75 of measurement standard 70 in Y direction is a predetermined constant datum, a moving distance for every one pulse in Y direction is calculated from a difference between the first and second counted values and the predetermined constant datum above described by the arithmetic and logic control means 111, and this moving distance in Y direction is stored in the second memory 115.

Figure 11:
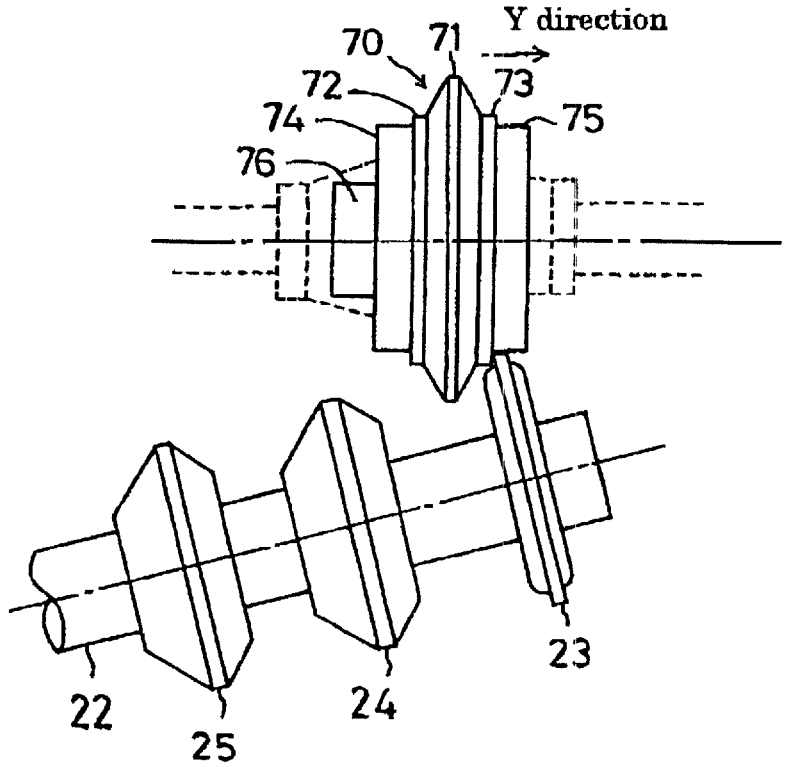
FIG. 11 is an explanatory view to show a state in which the lens axis is shifted along Y direction.

An X count value along X direction as a difference between a state shown in FIG. 10 and a state shown in FIG. 11 is calculated from the counted values stored in the first memory 114 and this calculated X value (the moving distance in X direction shown in FIG. 12) is stored in the first memory 114. Because a value which is obtained by a subtraction of the radius of third disk 75 from the radius of second disk 73 of the measurement standard 70 is a predetermined constant datum a moving distance for every one pulse in X direction is calculated from the calculated X value stored in the first memory 114 and the predetermined constant datum above described by the arithmetic and logic control means 111, and this moving distance in X direction is stored in the second memory 115.

As described above in the present invention a contact between the measurement standard 70 and the ditch excavation grind stone 23 is arranged to detect by the sensor 57, the pulse numbers of pulse motor 55 and M2 are correctly counted by the counter 113 and as a result of this moving distances for every one pulse along X direction and Y direction can be correctly calculated.

The above calculated data of moving distances are compared by the arithmetic and logic control means 111 with data of moving distances for every one pulse along X direction and Y direction which were stored beforehand, when in a case they are different the above calculated data of moving distance are stored in the second memory 115 as actual data for moving distances along X direction and Y direction, the initial position of the ditch excavation grind stone 23 is corrected (calibrated) with the actual data, because the pulse numbers of pulse motors 55 and M2 are controlled on a basis of the actual moving distances along X direction and Y direction which are stored in the second memory 115, the lens rotating shafts 14, 14 can be accurately moved and shifted in X direction and Y direction and as a result of this the grinding work for lens to be processed L can be correctly performed.

Figure 13:
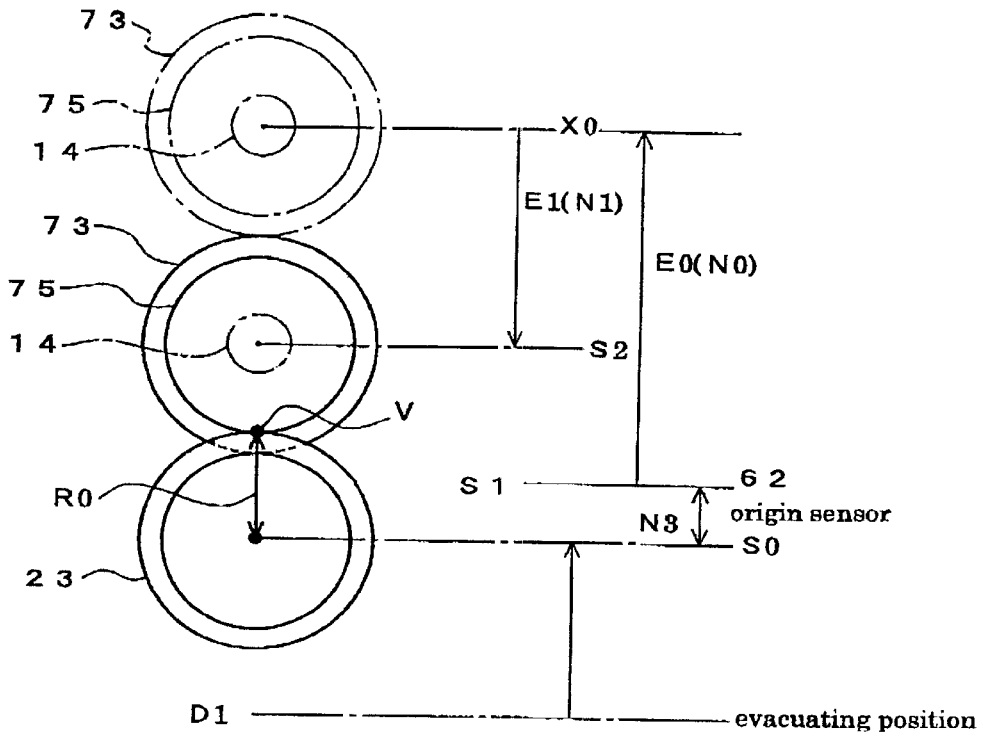
FIG. 13 is an explanatory view to show a positional relation between the measurement standard and the ditch excavation grind stone.

At this point the third disk 75 of measurement standard 70 is moved upward for a predetermined height E0 (a predetermined number of pulse N0) from a position S1 of the origin sensor 62, the ditch excavation grind stone 23 is also moved upward for a height in compliance with the predetermined number of pulse from the evacuating position D1 and is located in a position S0 as shown in FIG. 13. And when it is supposed that a moving distance for the third disk 75 going downward from a position depicted with the dashed line to a position S2 where the third disk 75 is contacted with the ditch excavation grind stone 23 is E1 (pulse number N1), the position S0 of the ditch excavation grind stone 23 is well known, the position of the origin sensor 62 is also well known, and the pulse number N3 of a distance between position S1 and the position S0 is well known. Further a radius r of the third disk 75 of measurement standard 70 is also well known. Accordingly when a value N0−N1+N3−r is calculated, because a radius R0 for the ditch excavation grind stone 23 can be obtained, an amount of abrasion loss for the ditch excavation grind stone 23 can be also calculated.

Furthermore a position V where the ditch excavation grind stone 23 and the third disk 75 of measurement standard 70 are contacted with reference to the position S0 as a criterion, and the position V is stored in the second memory 115 as an initial position for the origin of work position.

In other words the origin of work position V can be obtained when the measurement standard 70 is reciprocally moved in upward and downward and shifted along Y direction to calculate the moving distance for every one pulse along X direction and Y direction. That is to say a setting of the initial position can be achieved on a basis of data to obtain a calculation for moving distance for every one pulse along X direction and Y direction.

Figure 14:
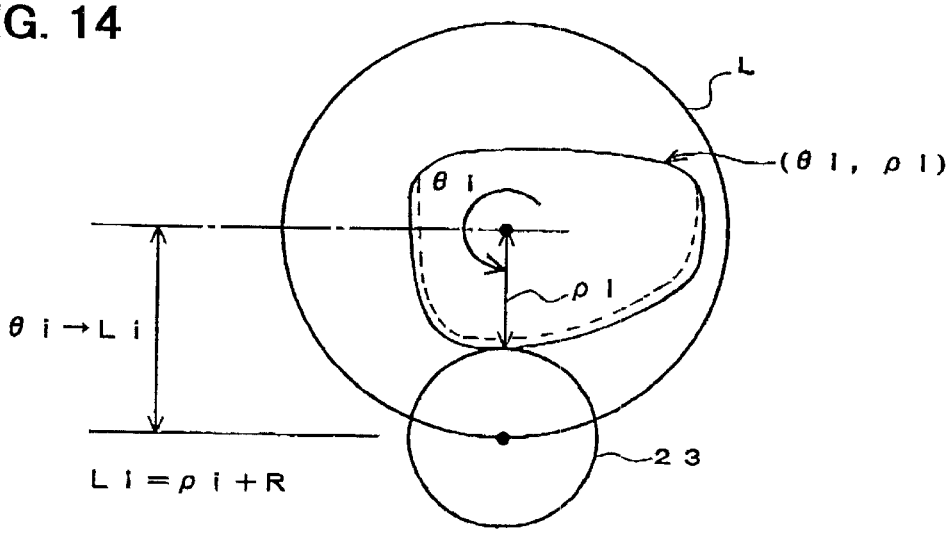
FIG. 14 is an explanatory view to show a state in which a grinding work is performed on a lens to be operated.

When the ditch excavation work is performed, a distance between the shafts Li=ρi+R0 is calculated from a radius vector information (θi, ρi) for work process by the frame reader 101 and the radius R0 of ditch excavation grind stone 28 as shown in FIG. 14, then the motor 33 and the pulse motors 55 and P1 are controlled to achieve the ditch excavation work by the ditch excavation grind stone 23 on a basis of calculated distance between the shafts Li.

(2) Method for Initial Position Setting of the Chamfering Grind Stones 24, 25

At first the same as for the ditch excavation grind stone 23, the measurement standard 70 is held between the lens rotating shafts 14, 14. And the pulse motor 55 is driven for the supporting table 56 to go upward in a predetermined height. A space between the grind stone 11 and the measurement standard 70 is made to be ensured in a certain extent. The pulse motor 37 is driven to swing the swing arm 21 and is controlled to set the chamfering grind stone 24, 25 in a predetermined position between the grind stone 11 and the lens rotating shaft 14.

Figure 15A:
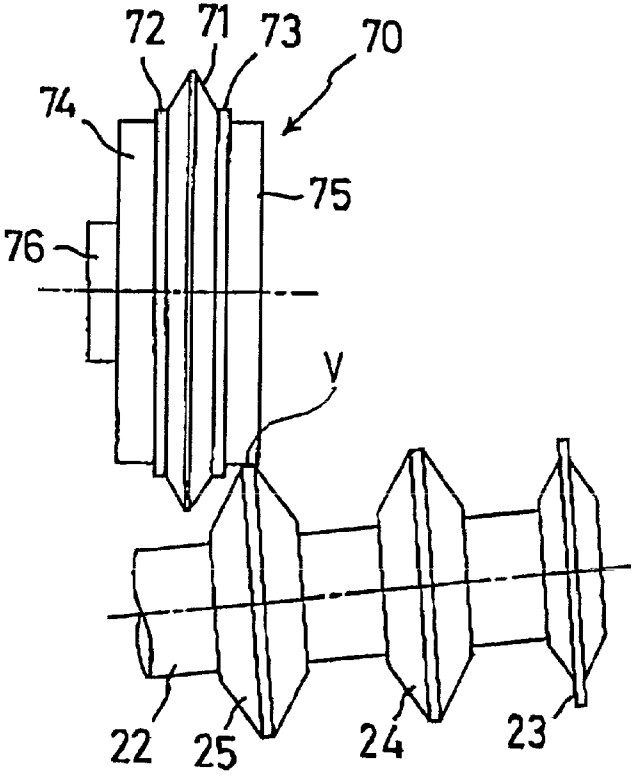
FIG. 15(A) is an explanatory view to show a state in which the chamfering grind stone is contacted with the third disk of the measurement standard.

Next the pulse motor 55 is driven for the first supporting table 56A to go downward and to make the measurement standard 70 going downward and upward with the lens rotating shafts 14, 14, and the pulse motor 55 is controlled for the third disk 75 and the second disk 73 of measurement standard 70 to be contacted with the chamfering grind stone 25 as shown in FIGS. 15(A) and (B), then the moving distance for every one pulse along X direction and Y direction is obtained in the same manner as described in (1), further the contacting position V shown in FIG. 15(A) is obtained and finally the obtained values are set as the initial position.

Figure 16:
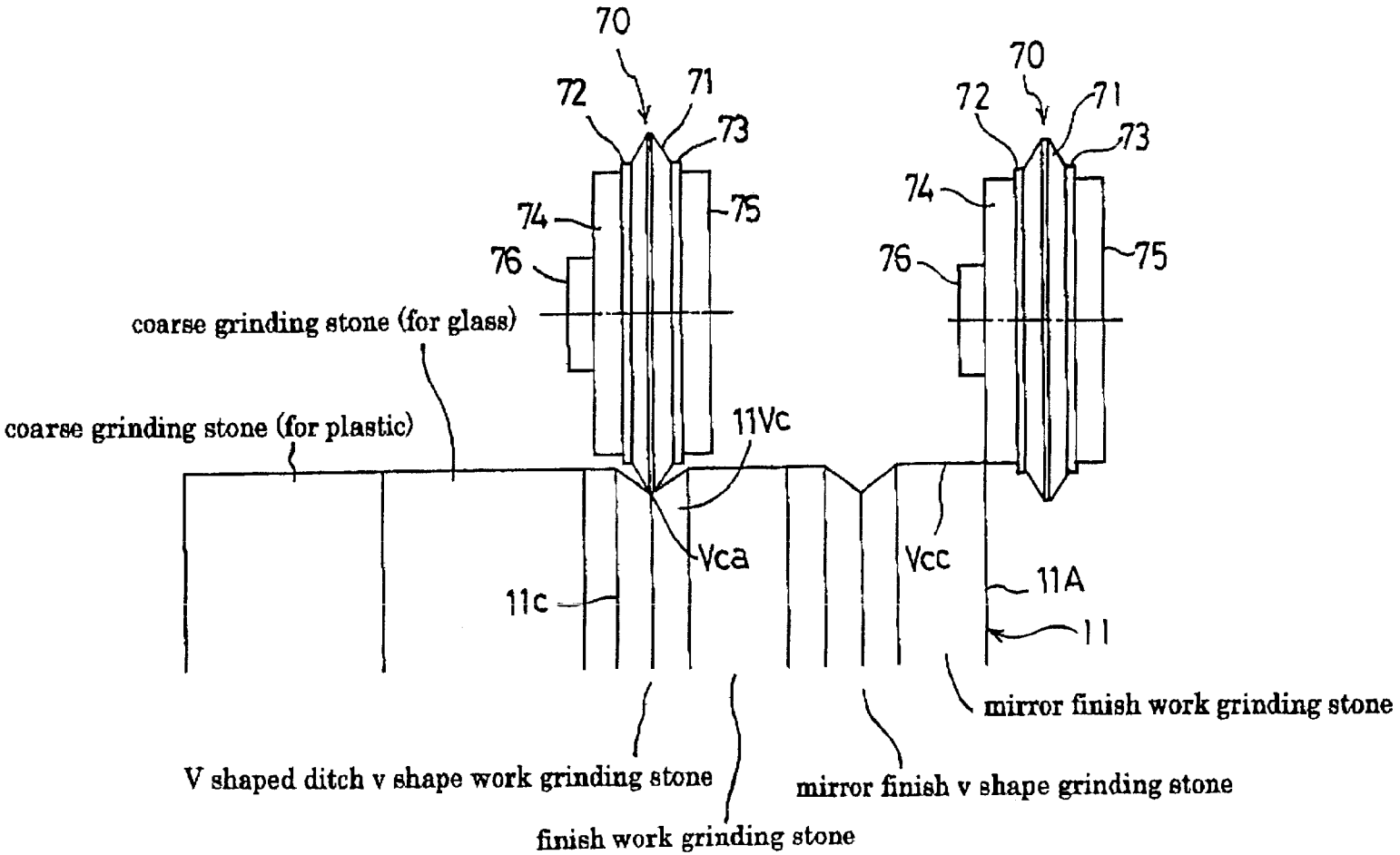
FIG. 16 is an explanatory view to show a state in which the third disk of the measurement standard runs upon an end portion of a mirror finishing work grind stone.
Figure 17:
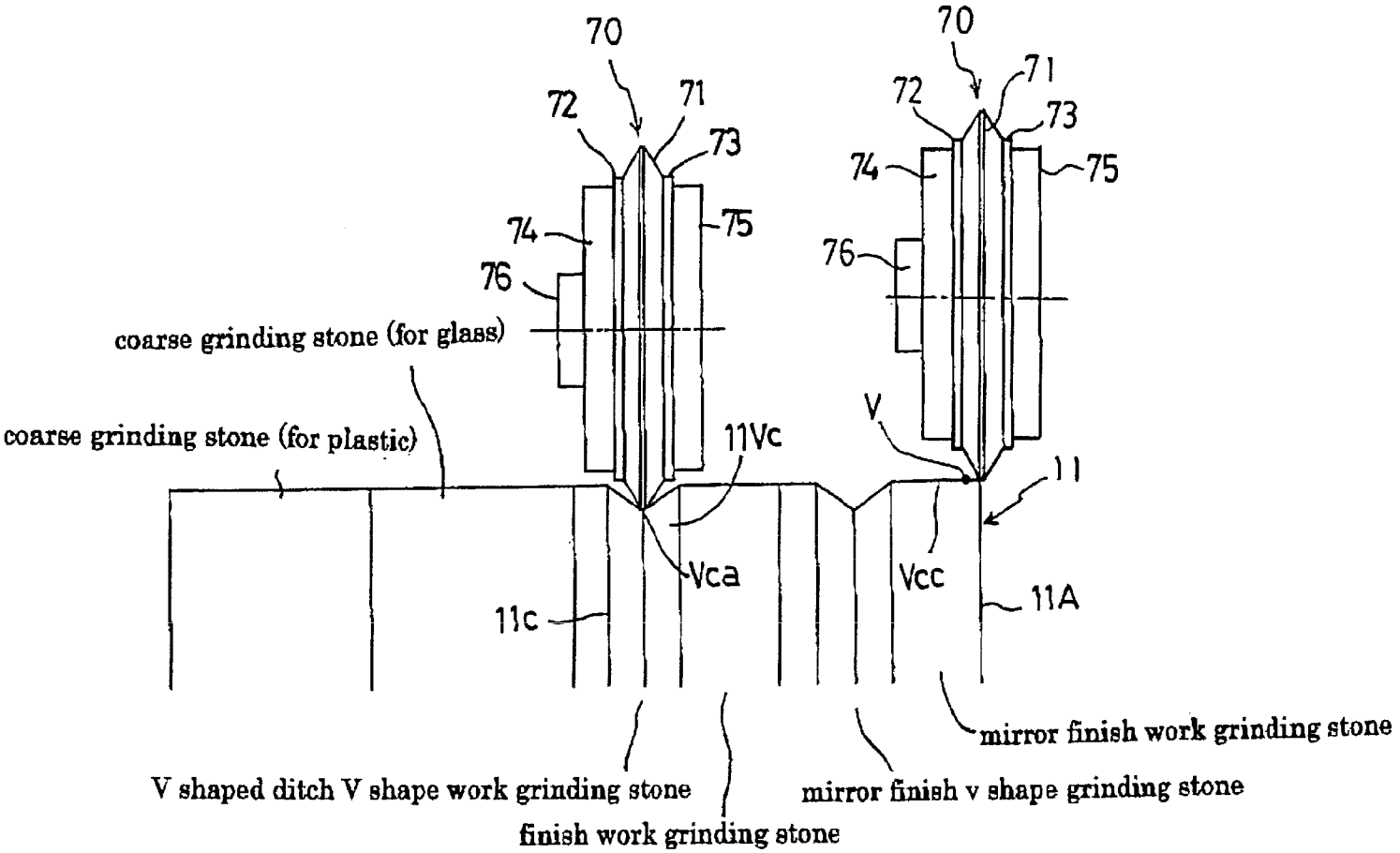
FIG. 17 is an explanatory view to show a state in which a first disk of the measurement standard runs upon an end portion of the mirror finishing work grind stone.

(3) Method for Initial Position Setting of V Shape Work Grind Stone and Flat Grind Stone FIG. 16 and FIG. 17 are drawings to show a method for setting an origin for the working position (initial position) of the V shape work grind stone and the flat grind stone.

In this case also the pulse motor 55 is driven for the first supporting table 56A to go downward and to make the measurement standard 70 going downward and upward with the lens rotating shafts 14, 14, and the pulse motor 55 is controlled for the third disk 74 and the first disk 71 of measurement standard 70 to be contacted with an end portion of the flat grind stone (mirror finish work grind stone) 11A as shown in FIG. 16 and FIG. 17, then the actual moving distance for every one pulse along X direction and Y direction is obtained in the same manner as described in (1), further the contacting position V is obtained and finally the obtained values are set as the initial position.

At this point in the grind stone 11 because respective widths and positions of the V shaped ditch of the respective coarse grinding work grind stones, the V shape work grind stone, the finishing work grind stone, and the likes are accurately specified, it is also recommendable that the actual moving distance along Y direction is obtained by that the first disk 71 of measurement standard 70 is made to be contacted with an end portion of the flat grind stone 11A and then the moving distance along Y direction is obtained when the first disk 71 is contacted on a bottom Vca of a V shaped ditch 11Vc as shown in FIG. 17.

At this point a decision whether the first disk 71 is contacted on the bottom Vca of the V shaped ditch 11Vc or not, is performed by that a contacting point of the first disk 71 is made coming nearer little by little to the bottom Vca of V shaped ditch 11Vc of the V shaped ditch V shape grind stone, and a point where the moving distance along the X direction is the largest is thought to be the bottom Vca of V shaped ditch 11Vc of the V shape work grind stone when the first disk 71 is moved from an inclined surface of the V shaped ditch V shaped ditch to the bottom Vca or from the bottom Vca to the inclined surface of V shaped ditch with keeping contact on the surface of V shaped ditch.

Effect of the Invention

As described above, in accordance with the present invention, the lens rotation shaft can be accurately moved and shifted in X and Y direction, by this arrangement the grinding work for the lens to be processed can be correctly performed. At the same time the initial position for the work can be accurately set.

What is claimed is:

1. Method for setting initial position of grinding work apparatus comprising the steps of:

holding, by lens rotating shafts, a measurement standard having a predetermined shape;

moving grind stones for ditch excavation and chamfering to a predetermined position within a trace line of said lens rotating shafts;

said lens rotating shafts being moved along a normal line of said grind stones in order for said measurement standard to contact with one of a ditch excavation grind stone or a chamfering grind stone of said grind stones for ditch excavation and chamfering;

detecting a contact of said measurement standard with one of said ditch excavation grind stone or said chamfering grind stone by a contact detecting means;

obtaining a moving distance of said lens rotating shafts when the contact detecting means detects the contact; and obtaining and setting an initial position of the lens rotating shafts on a basis of the moving distance and a dimension of said measurement standard.

2. Method for setting initial position of grinding work apparatus according to claim 1, wherein said measurement standard is composed with a first disk having a predetermined diameter and a second disk which is coaxially disposed outside of the first disk, and whose diameter is smaller than that of the first disk; and wherein initial setting of the ditch excavation grind stone or the chamfering grind stone is performed utilizing said measurement standard.

3. Method for setting initial position of grinding work apparatus comprising the steps of:

holding, by lens rotating shafts, a measurement standard with a predetermined shape;

said lens rotating shafts being moved along a normal line of grind stones, one being a V shape grind stone, and one being a flat grind stone, in order for said measurement standard to contact with one of said V shape grind stone or said flat grind stone;

detecting a contact of said measurement standard with one of said V shape grind stone or said flat grind stone by a contact detecting means;

obtaining a moving distance of said lens rotating shafts when the contact detecting means detects the contact; and obtaining and setting an initial position of the lens rotating shafts on a basis of the moving distance and a dimension of said measurement standard.

4. Method for setting initial position of grinding work apparatus according to claim 3, wherein said V shape grind stone is a V shaped ditch V shape grind stone having a V shaped ditch; wherein the measurement standard is composed with a first disk which has a predetermined diameter and a chevron shape to be engaged with the V shaped ditch of said V shaped ditch V shape grind stone, a second disk which is coaxially disposed outside of the first disk and whose diameter is smaller than that of the first disk, and a third disk which is coaxially disposed outside of the second disk and whose diameter is smaller than that of the second disk; and wherein initial setting of the V shape grind stone or the flat grind stone is performed utilizing the measurement standard.

* * * * *